United States Patent [19]

Cognard

[11] Patent Number: 4,580,907

[45] Date of Patent: Apr. 8, 1986

[54] WATCH CASE

[75] Inventor: Jacques Cognard, Neuchâtel, Switzerland

[73] Assignee: ETA S.A. Fabriques d'Ebauches, Granges, Switzerland

[21] Appl. No.: 628,057

[22] Filed: Jul. 5, 1984

[30] Foreign Application Priority Data

Jul. 8, 1983 [CH] Switzerland ..... 3757/83

[51] Int. Cl.[4] ..... G04B 37/00

[52] U.S. Cl. ..... 368/281; 368/294

[58] Field of Search ..... 368/281, 294–296

[56] References Cited

U.S. PATENT DOCUMENTS

| | | | |
|---|---|---|---|
| 4,218,873 | 8/1980 | Lang | 368/281 |
| 4,421,423 | 12/1983 | Lederrey | 368/281 |
| 4,487,513 | 12/1984 | Matsumoto | 368/296 |

*Primary Examiner*—Bernard Roskoski

*Attorney, Agent, or Firm*—Pollock, Vande Sande & Priddy

[57] ABSTRACT

A watch case is described made of metal or metal compound, comprising a back, a middle and a bezel. The case is made up of a stack of plates with one plate forming the back cover and the others being formed with openings and forming the middle and the bezel.

15 Claims, 3 Drawing Figures

WATCH CASE

BACKGROUND OF THE INVENTION

This invention relates to a watch case made of metal or metal compound.

At present, watch cases made of metal compound are produced by sintering and watch cases made of metal are produced by stamping, pressing, swaging or moulding, prior to being subjected to finishing operations which, because of the complex outer shape of watch cases, need to be carried out in several stages and account for a substantial proportion of the cost price of the product.

SUMMARY OF THE INVENTION

An object of the invention is to reduce the cost of manufacturing watch cases made of metal or metal compound, while at the same time providing scope for novel aesthetic effects.

According to the invention there is provided a watch case made of metal or a metal compound, which comprises a middle and a back and which comprises a stack of plates with one plate forming the back and with the remaining plates being formed with openings and forming the middle.

DETAILED DESCRIPTION

Figure 1B:
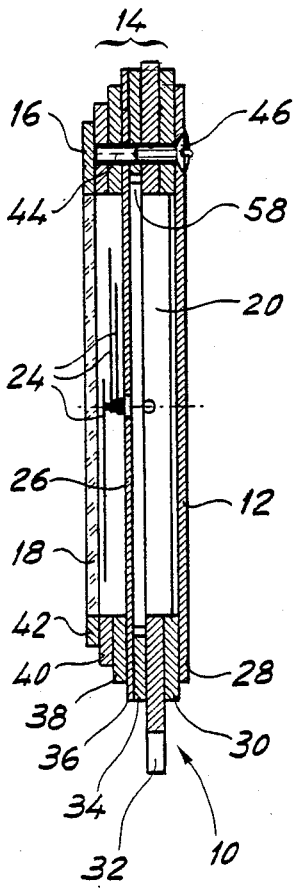
FIGS. 1*a* and 1*b* are respectively plan and side views of a watch having a case according to the invention.
Figure 1A:
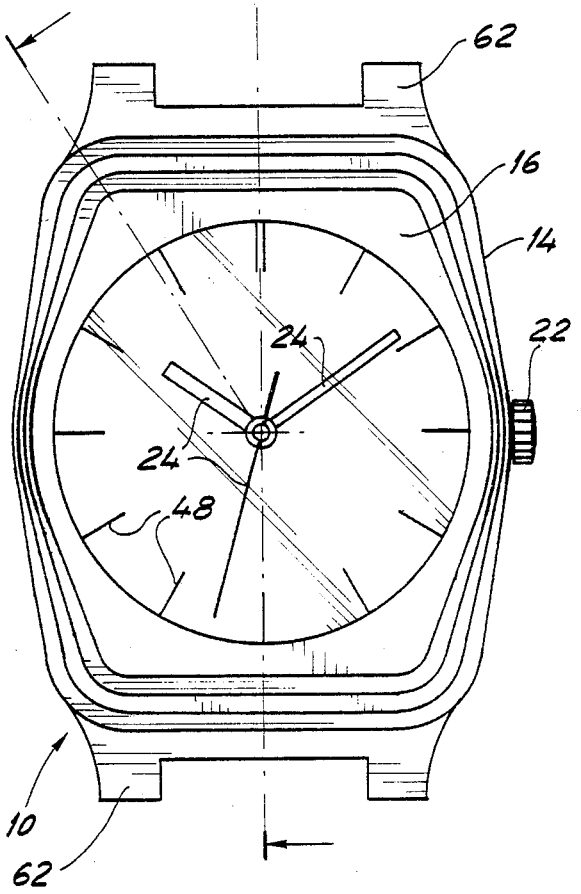

The watch shown in FIGS. 1*a* and 1*b* comprises a case 10 having a back cover 12, a middle 14, a bezel 16 and a glass 18. Case 10 contains a movement 20, a setting stem 22, hour, minute and second hands 24 and a dial 26.

Watch case 10 is made up of a stack of eight plates, 28 to 42. Back cover 12 is formed by plate 28 and bezel 16 is formed by plate 42. Intermediate plates 20 to 40 form middle 14, with plate 36 also acting as dial 26.

Plates 28 to 42 are of roughly hexagonal shape and are externally so sized as to form a middle of stepped outline, as is apparent from FIGS. 1*a* and 1*b*.

Figure 2:
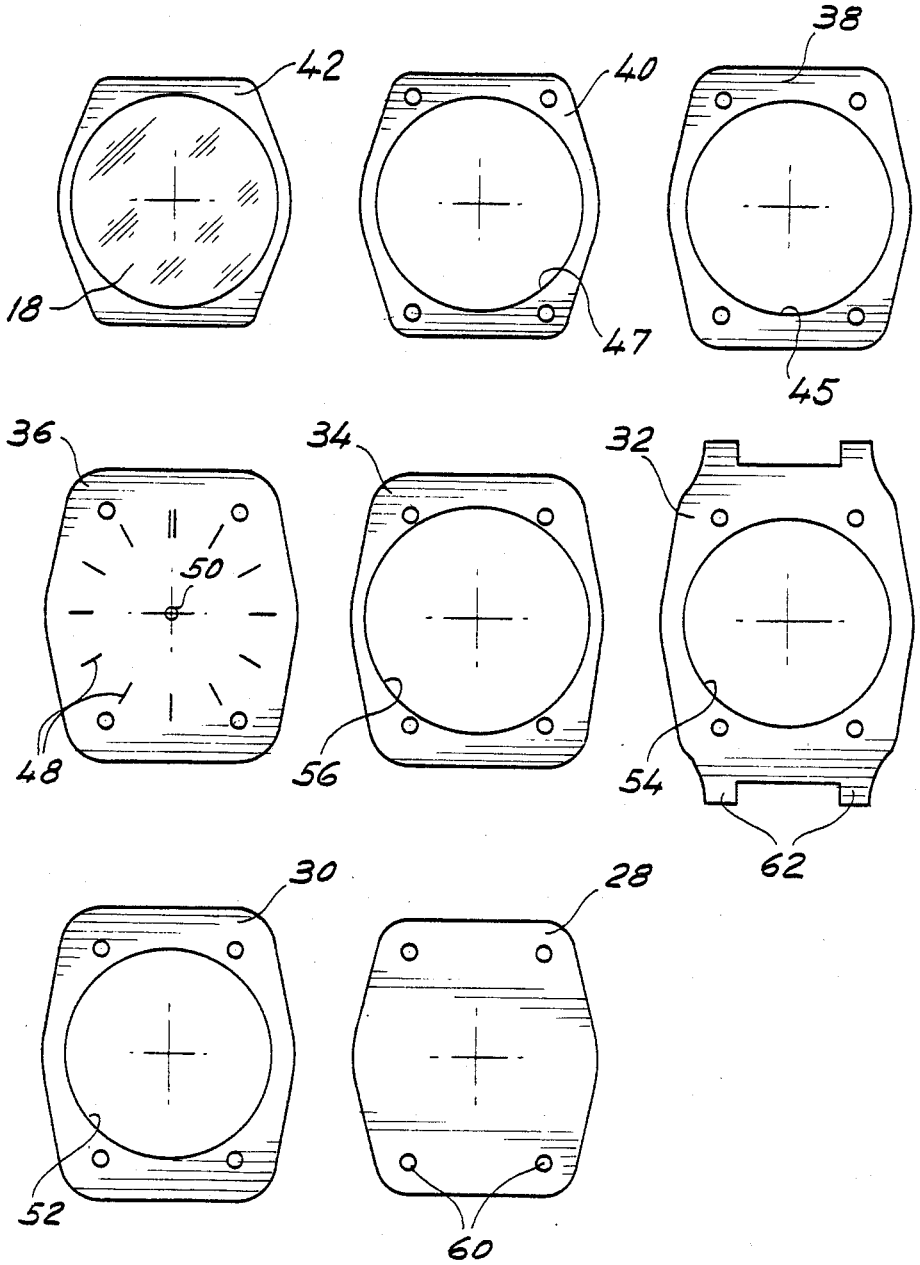
FIG. 2 is a plan view of plates used in making the case of the watch shown in FIGS. 1*a* and 1*b*.

Plates 28 to 42 are held together by four tapped studs soldered to uppermost plate 42 and by four screws 46 engaged in studs 44 with their heads bearing on lowermost plate 28, studs 44 and screws 46 extending through holes 60 (FIG. 2) formed in plates 28 to 40. FIG. 1*b* shows only one stud and one screw.

Plate 42 is provided with a central circular opening closed off by glass 18 preferably held in place with adhesive. Alternatively, plate 42 could itself be transparent and act as a glass.

Plates 38 and 40 are formed with circular openings 45 and 47 that define a housing for hands 24. Dial plate 36 carries time division symbols 48 and is provided with a small central opening 50 through which extend the spindles bearing the hands. Plates 30, 32 and 34 are respectively provided with circular openings 52, 54 and 56 that define a housing for watch movement 20. Opening 56 is slightly larger than openings 52 and 54 to enable the inner edge of plate 32 to be used as a seating for a flange 58 provided around the upper portion of movement 20.

Plate 32 further has a pair of wristlet securing lugs 62.

Instead of being assembled with screws, plates 28 to 42 could simply be bonded with adhesive. In so doing a water resistant but non repairable watch is produced.

If it is nonetheless desired to have an openable case, a mixed arrangement may be adopted, consisting in assembling with adhesive firstly plates 28, 30, 32 and 34 and secondly plates 38, 40 and 42. Movement 20 is then placed in the shell formed by plates 28, 30, 32 and 34. Dial plate 36, followed by hands 24, are then fitted. Hands 24 are then capped by the set of adhesively bonded plates 38, 40 and 42 and the resulting assembly is fastened with screws.

It is also possible to have an openable watch involving no screws by securing plates 34 and 38 to the opposite sides of dial plate with adhesive that can be dissolved with warm water.

Alternatively, the watch could, in a more conventional manner, have a dial that is borne by the movement. Dial plate 36 would then have an opening of substantially the same size as openings 44 and 46 in plates 38 and 40.

The choice of materials used in making the plates is governed by their cost, their appearance, their mechanical strength and their resistance to chemical attack.

Metals and metal compounds are best suited. Stainless steel, because of its moderate cost, its attractive appearance, its mechanical strength, its resistance to chemical attack and its machinability, is particularly suitable for the manufacture of the above described case. Copper and aluminium alloys provide great scope for colouring because of the many kinds of surface treatment they can be subjected to.

Particularly strong cases can be made by resorting to plates made of metal compounds such as the nitrides, carbides and borides of tantalum, titanium, tungsten, vanadium, etc., and oxides such as alumina.

Metal plates are preferably cut out of strips by means of a progressive swage which first cuts the inner openings before cutting the outer shape. Metal compound plates are produced by sintering, in moulds defining the inner and outer shapes.

In both cases, the plates are subsequently subjected to finishing operations involving grinding, brushing and/or polishing. Because the plates are flat, these operations can be automated.

The plates are finally subjected, if need be, to a surface treatment that determines their final appearance, whereupon they are assembled as already described.

To modify the outer shape of the case, it suffices to change one punch and one die in each of the progressive swages, or the outer part of the mould. The cost of these changes is low, the shapes being on the whole very straightforward.

It will be apparent that the invention enables the manufacturing costs of watch cases to be lowered while still providing scope for case design, in particular the external aspect of middles.

I claim:

1. A watch case for housing a display means for displaying time and a movement means for providing said time, said case providing an exterior outline for a watch and comprising:

at least one display plate having an opening for housing at least part of said display means and an outer edge portion providing part of said exterior outline;

at least two movement plates each having an opening for housing at least part of said movement means and an outer edge portion providing part of said exterior outline;

a back plate having an outer edge portion providing part of said exterior outline; and, means for securing said plates together in a stack so as to provide a case structure, said at least two movement plates being substantially flat and stacked one on top of another, and said back plate being an outermost plate of said stack and arranged to close off the back side of said case structure.

2. The watch case of claim 1 which further includes a bezel plate as an outermost plate arranged to close off the front side of said case structure, and having at least a portion made of a transparent material for viewing said display means and an outer edge portion providing part of said exterior outline.

3. The watch case of claim 2 in which said bezel plate comprises a central glass portion supported by an outer rim portion of a metallic material.

4. The watch case of claim 1 wherein comprises at least two of said display plates.

5. The watch case of claim 1 in which said display means includes a dial and hands, and in which said dial comprises one of the plates of said stack.

6. The watch case of claim 1 in which at least one of the plates of said stack has wristlet securing lugs.

7. The watch case of claim 1 in which the plates of said stack are made of stainless steel.

8. The watch case of claim 1 in which the plates of said stack are made of a boride, nitride or carbide of vanadium, tungsten, titanium or tantalum.

9. The watch case of claim 1 in which at least part of said securing means comprises an adhesive.

10. The watch case of claim 1 in which at least part of said securing means comprises screws.

11. A watch case for housing a display means having a dial and hands for displaying time and a movement means for providing said time, said case providing an exterior outline for a watch and comprising:

at least one display plate having an opening for housing at least part of said display means and an outer edge portion providing part of said exterior outline;

at least two movement plates each having an opening for housing at least part of said movement means and an outer edge portion providing part of said exterior outline;

a back plate having an outer edge portion providing part of said exterior outline;

a dial plate providing said dial;

a bezel plate having at least a portion thereof made of transparent material for viewing said display means and an outer edge portion providing part of said exterior outline; and, means for securing said plates together in a stack so as to provide a case structure;

said back plate being an outermost plate of said stack and arranged to close off the back side of said case structure; and, said bezel plate being an outermost plate of said stack and arranged to close off the front side of said case structure.

12. The watch case of claim 11 in which said dial plate has an outer edge portion providing part of said exterior outline.

13. The watch case of claim 1 in which all of said plates are substantially flat and are stacked one on top of another.

14. The watch case of claim 1 in which said at least one display plate and said at least two movement plates each have a swaged opening and a swaged outer edge portion.

15. The watch case of claim 1 in which the opening in one of said movement plates is larger than the opening in another of said movement plates so as to provide a seat for a flange around a portion of said movement means.

* * * * *